US012173438B1

(12) United States Patent
Taylor

(10) Patent No.: US 12,173,438 B1
(45) Date of Patent: Dec. 24, 2024

(54) EMBROIDERY FRAME

(71) Applicant: Durkee Embroidery, Inc., Mooresville, NC (US)

(72) Inventor: Claude Brent Taylor, Davidson, NC (US)

(73) Assignee: Durkee Embroidery, Inc., Mooresville, NC (US)

( * ) Notice: Subject to any disclaimer, the term of this patent is extended or adjusted under 35 U.S.C. 154(b) by 0 days.

(21) Appl. No.: 18/536,919

(22) Filed: Dec. 12, 2023

Related U.S. Application Data

(63) Continuation of application No. 18/362,029, filed on Jul. 31, 2023.

(51) Int. Cl.
*D05C 1/02* (2006.01)

(52) U.S. Cl.
CPC ..... *D05C 1/02* (2013.01); *D05D 2205/06* (2013.01); *D05D 2207/05* (2013.01)

(58) Field of Classification Search
CPC ... D05C 1/02; D05C 1/04; D05C 9/04; D05D 2207/05; D05B 39/00
USPC ..... 112/103
See application file for complete search history.

(56) References Cited

U.S. PATENT DOCUMENTS

| | | | |
|---|---|---|---|
| 5,138,960 | A | 8/1992 | Inteso |
| 2008/0276849 | A1 | 11/2008 | Mack et al. |
| 2012/0017814 | A1 | 1/2012 | Mack et al. |
| 2015/0059631 | A1 | 3/2015 | Katano et al. |
| 2019/0338450 | A1 | 11/2019 | Kawaguchi et al. |
| 2020/0024783 | A1 | 1/2020 | Ueda et al. |

*Primary Examiner* — Nathan E Durham
(74) *Attorney, Agent, or Firm* — Trego, Hines & Ladenheim, PLLC; Thomas D. McClure, Jr.

(57) ABSTRACT

The present invention provides an embroidery frame that has at least three sections. The at least three sections include a base section that defines a perimeter. An alignment section is configured to be positioned on the base section such that it covers a first portion of the perimeter of base section while leaving a second portion of the perimeter of the base section uncovered. A retention section that is configured to cover the second portion of the perimeter of the base section. The retention section is configured be engaged with the alignment section such that alignment of the retention section with the base section is determined by alignment of the alignment section with the base section. At least one of the alignment section and the retention section is configured to be magnetically attached to the base section.

19 Claims, 10 Drawing Sheets

EMBROIDERY FRAME

BACKGROUND OF THE INVENTION

This invention relates generally to embroidery frames for machine embroidery and more specifically to embroidery frames having multicomponent top sections that are magnetically secured to a bottom section.

BACKGROUND

Various types of conventional embroidery frames for machine embroidery are known. Conventional embroidery frames include a top section and a bottom section that are configured to retain a layer or layers of flexible fabric such as woven cloth, nonwoven cloth, leather, polymer films, and the like held securely between them. The top section is secured to the bottom section by magnetic attraction.

One problem with embroidery frames that are secured by magnetic attraction is that, in some circumstances, the magnetic force can cause the top section and the bottom section to snap together uncontrollably when the frame is being assembled. In this regard, an operator can lose grip on one or both of the top and bottom sections as the operator is moving the top and bottom sections toward each other. The top and bottom sections snap together quickly and with force and control is lost. This presents a potential danger to the operator who can be injured if a finger or other body part is caught between the top and bottom sections as they snap together with force. The potential for this problem occurring increases for operators who have limited strength or manual dexterity due to illness, aging, or injury.

Another problem occurs as the embroidery frame is being disassembled. The magnetic force between the top and bottom sections can be such that an operator cannot generate enough force to separate the top section from the bottom section while at the same time maintaining control of both sections. This situation can result in injury in the same manner as described above for assembly. Again, this situation is more likely to occur for operators having reduced strength or dexterity.

BRIEF SUMMARY OF THE INVENTION

These problems are addressed by an embroidery frame having a multicomponent top section and combined with a base section. The multicomponent top section includes an alignment component and a retention component. The alignment component is configured to be magnetically attached to and aligned with the base section in a first step. In a second step, the retention component is engaged with the alignment component. In a third step, the retention component is moved relative to the alignment component such that the retention component is magnetically attached to the base section.

The retention component is configured to be precisely aligned with the alignment component by a combination of alignment pintles or keys formed on one of the alignment component and the retention component and slots formed in the other of the alignment component and retention component. Additionally, the retention component is configured to rotate about the alignment component to assemble or disassemble the embroidery frame.

According to one aspect of the technology described herein, an embroidery frame is provided that has at least three sections. The at least three sections include a base section, and alignment section, and a retention section. The base section defines a perimeter. The alignment section is configured to be positioned on the base section such that it covers a first portion of the perimeter of the base section while leaving a second portion of the perimeter of the base section uncovered. The retention section is configured to cover the second portion of the perimeter of the base section. The retention section is configured to be engaged with the alignment section such that alignment of the retention section with the base section is determined by alignment of the alignment section with the base section. At least one of the alignment section and the retention section is configured to be magnetically attached to the base section.

According to another aspect of the present technology described herein, there is provided an embroidery frame having two hoops. The frame includes a base hoop and a top hoop. The top hoop is comprised of an alignment section and a retention section. At least one of the alignment section and the retention section is configured to be magnetically attached to the base hoop.

According to yet another aspect of the present technology described herein, there is provided a method for operating an embroidery frame. The embroidery frame includes a base section, an alignment section that is configured to be positioned on the base section, a retention section that is configured to be engaged with the alignment section such that the alignment of the retention section with the base section is determined by the alignment of the alignment section with the base section. Both the alignment section and the retention section are configured to be magnetically attached to the base section. The method includes the steps of: positioning stabilizer (also known as backing) and fabric over the base; positioning the alignment section such that the fabric is sandwiched between the alignment section and a portion of the base and the alignment section is positioned in a predetermined position relative to the base; positioning the retention section such that the retention section is movably engaged with the alignment section and in a first position not directly engaged with the base section; closing the retention section while it is engaged with the alignment section by moving the retention section from the first position to a second position in which the retention section is positioned such that the fabric is sandwiched between the retention section and the base section; opening the retention section while it is engaged with the alignment section by moving the retention section from the second position, closed position, to the first position, open position; removing the retention section from the alignment section; removing the alignment section from the base; and removing the fabric from the base.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
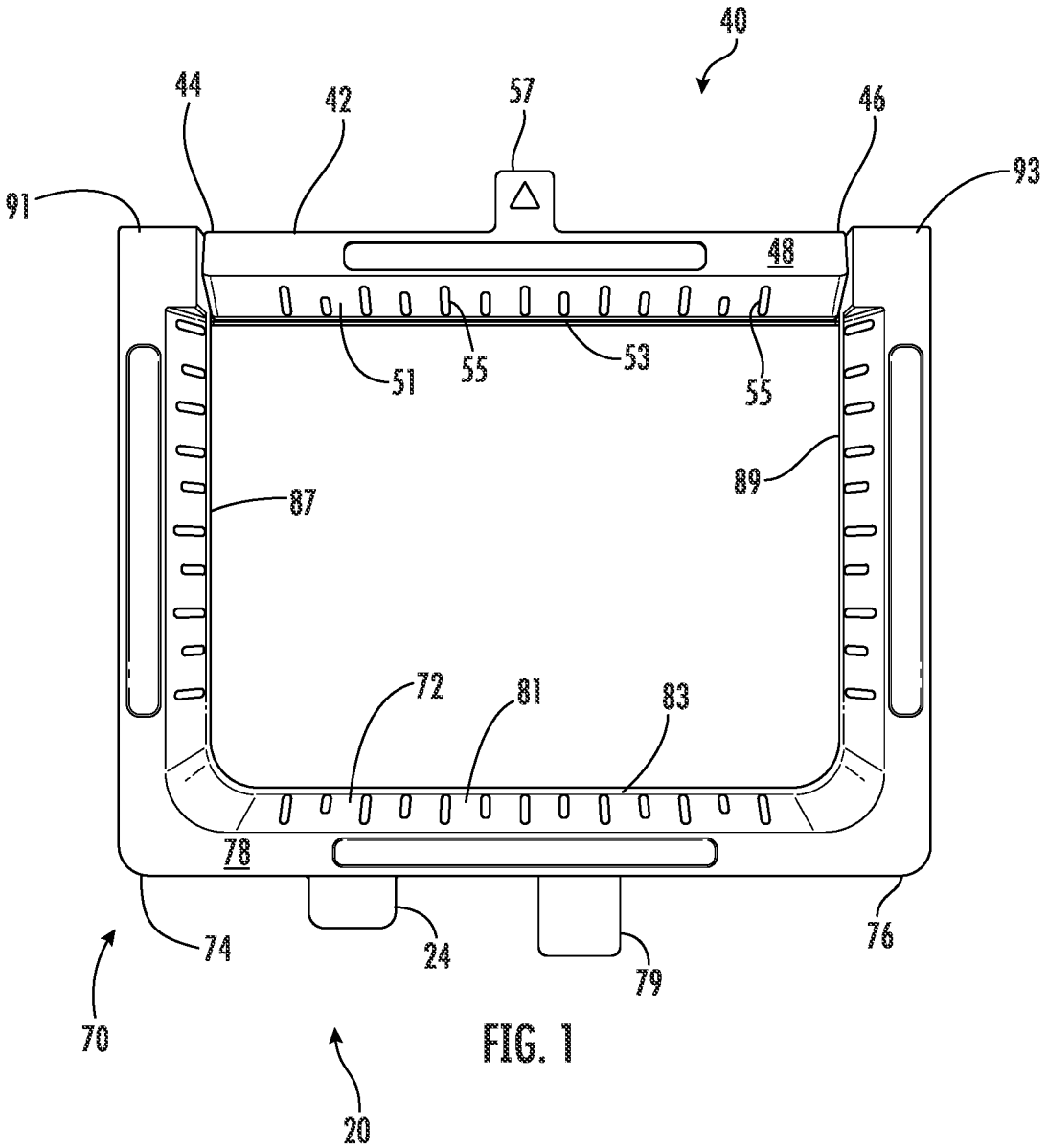
FIG. 1 is a plan view of an alignment section and a retention section of the embroidery frame assembled together according to the present technology.

Referring to the drawings wherein identical reference numerals denote the same elements throughout the various views, the disclosed technology provides an embroidery frame 10 having at least three sections. The embroidery frame 10 includes a base section 20, an alignment section 40 that is configured to be positioned on the base section, and a retention section 70. The alignment section 40 and the retention section 70 are configured to be engaged with each other such that the retention section 70 can, by way of a hinged motion, move relative to the alignment section and the alignment section 40 and the retention section 70 cooperatively sandwich fabric 14 against the base section 20.

Figure 2:
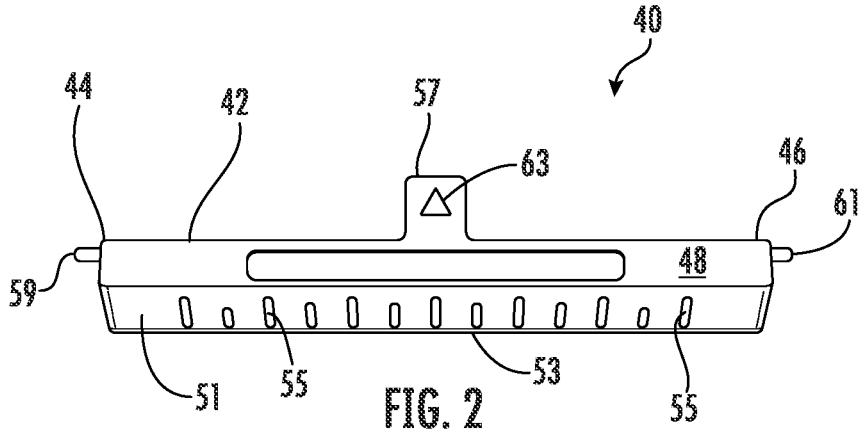
FIG. 2 is a plan view of the alignment section shown in FIG. 1.
Figure 6:
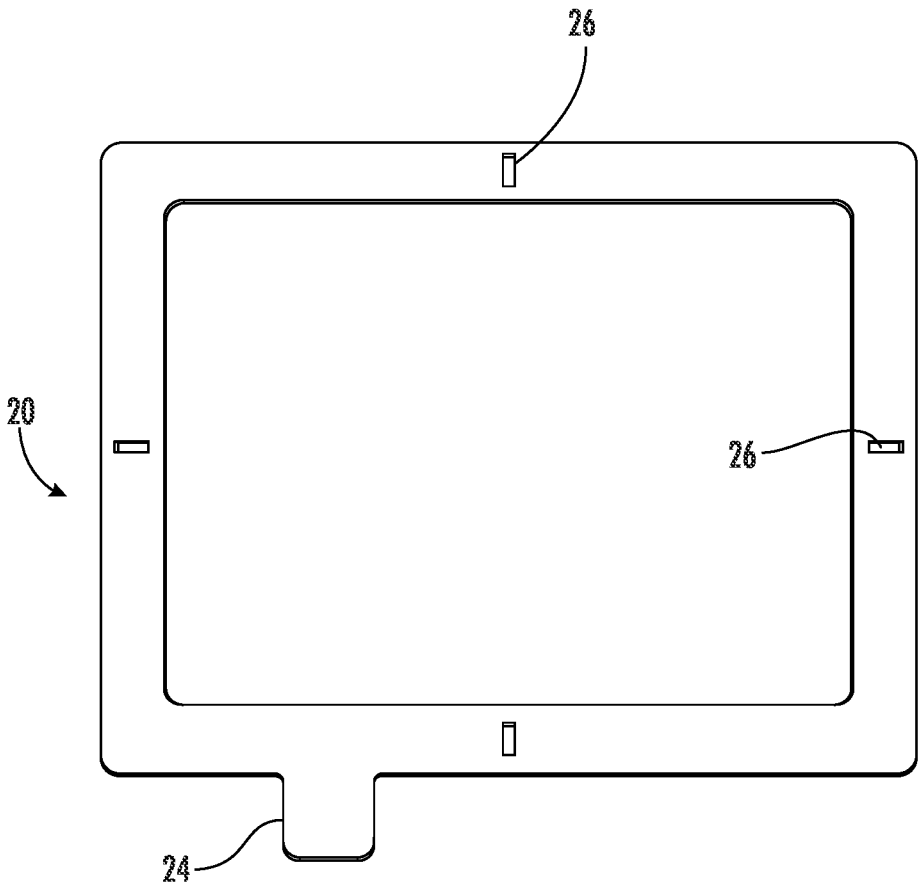
FIG. 6 is a plan view of a base section of the embroidery frame according to the present invention.
Figure 7:
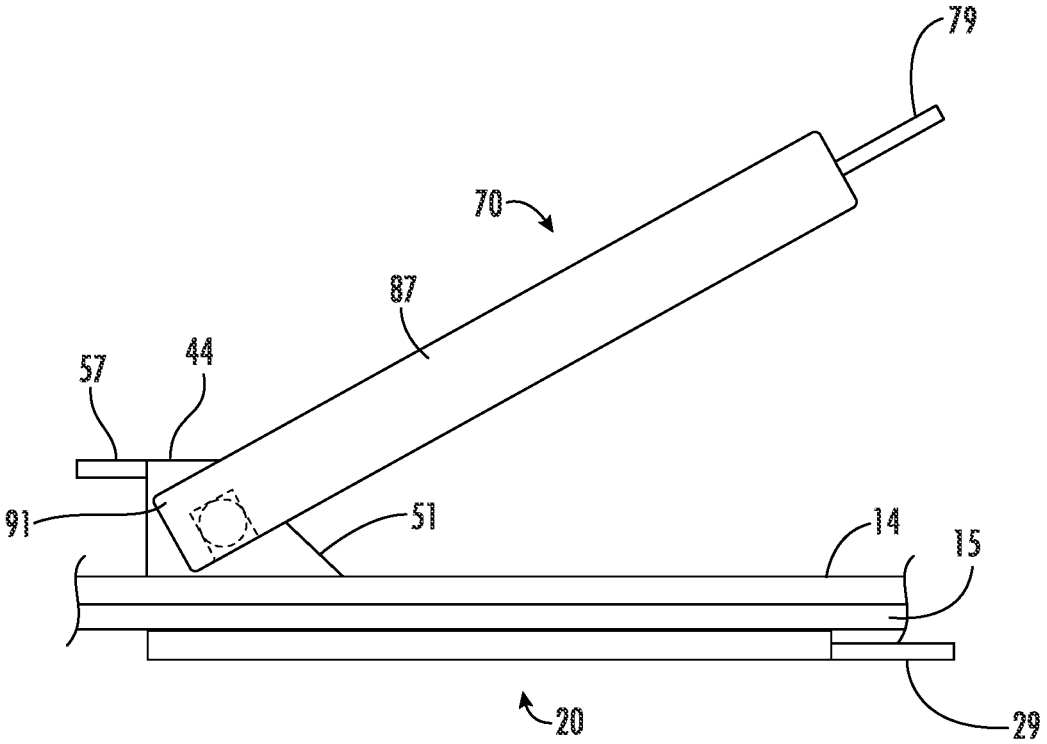
FIG. 7 is a side view of the embroidery frame according to the present invention with cloth positioned between the base section and the alignment section wherein the retention section is in a first position relative to the alignment section.
Figure 8:
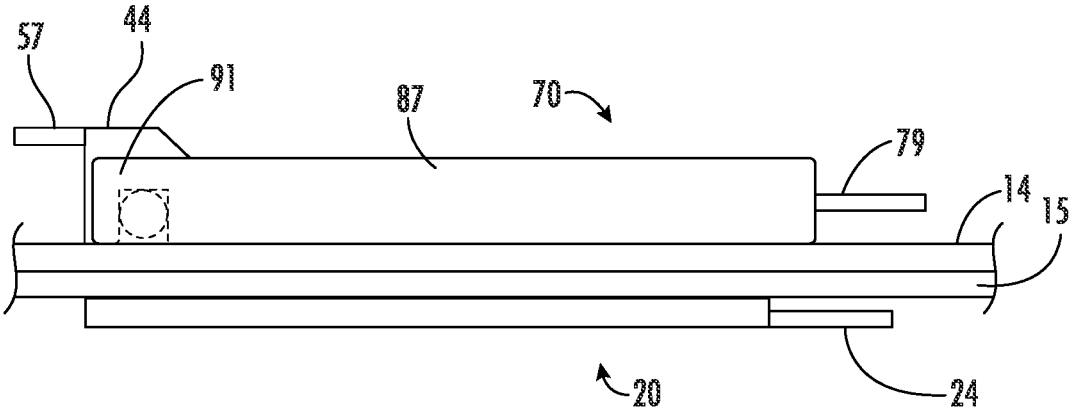
FIG. 8 is a side view of the embroidery frame according to the present invention with cloth positioned between the base section and the alignment section wherein the retention section is in a first position relative to the alignment section.

Referring now to FIGS. 1, 2, and 6, the base section 20 is generally rectilinear and encloses a space within a frame 22 from which a tab 24 extends. The alignment section 40 includes a body 42 that extends from a first end 44 to a second end 46. The body 42 defines a top surface 48 and an index side 51 that slopes from the top surface 48 to an edge 53. A plurality of index marks 55 are defined on the index side 51. A tab 57 extends away from the body 42 opposite the index side 51. As shown in FIG. 1, the tab 57 is positioned substantially centrally within the body 42 and substantially at the surface 48. As can be seen in FIG. 2, a first pintle 59 extends from the first end 44 of the body 42. A second pintle 61 extends from the second end 46 of the body 42.

Figure 9:
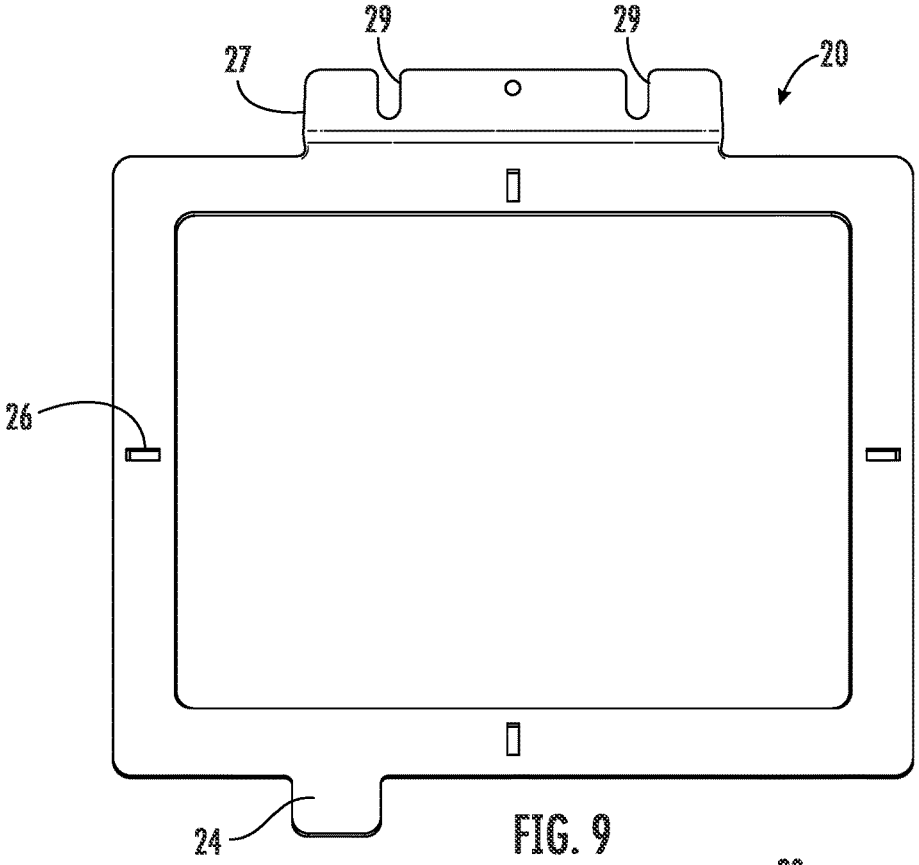
FIG. 9 is a plan view of a base section of the embroidery frame according to another embodiment of the present invention.
Figure 10:
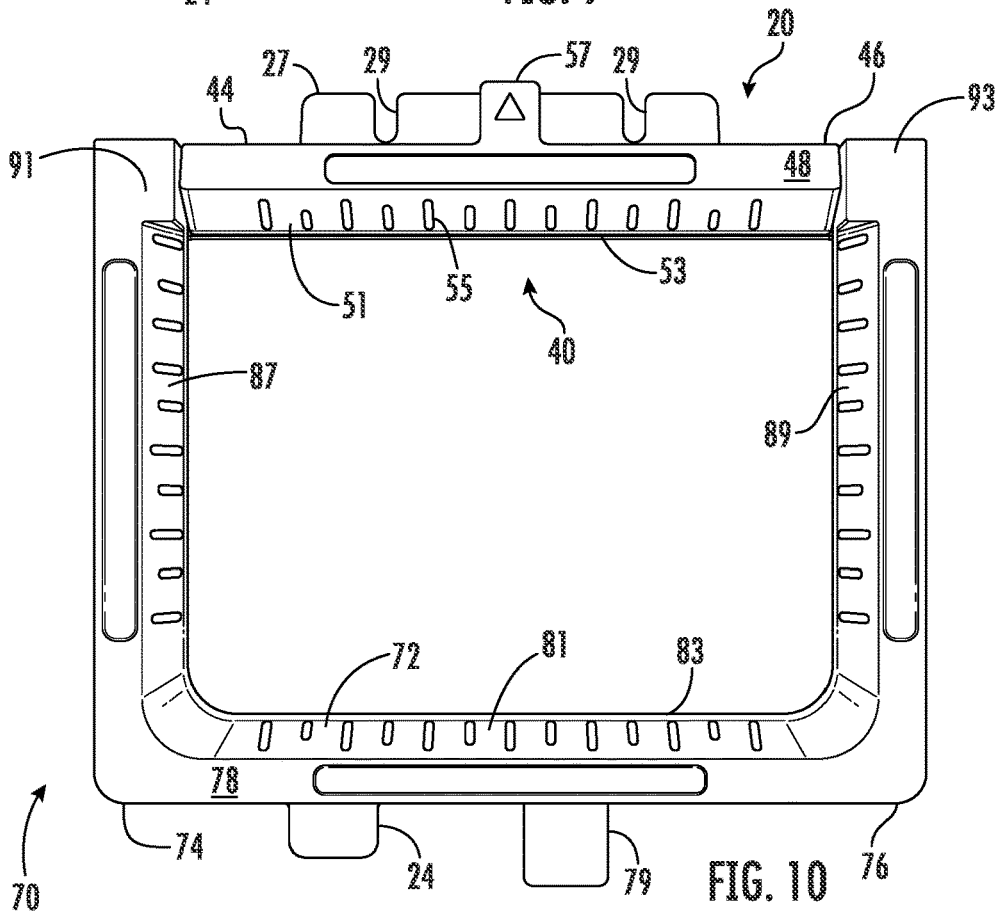
FIG. 10 is a plan view of the embroidery frame according to the embodiment of the present invention of FIG. 6.

The alignment section 40 is configured to be positioned on the base section 20. The alignment section 40 is configured to be aligned with the base section 20 in a predetermined and repeatable manner. In this regard, an alignment mark 63 is defined on the tab 57. The alignment mark 63 is configured to be used to provide consistent repeatable alignment of the alignment section 40 with the base section 20. In this regard, the base section 20 is provided with a reference mark 26 or physical index to which the location of the alignment mark 63 can be correlated. The base section 20 can include a connector 27 that is configured to connect the base section 20, and therefore the embroidery frame 10, to an embroidery machine utilizing a separate adaptor arm. As shown in FIG. 9, the connector 27 includes features 29 that provide a keyed fit for a particular method of attachment to some embroidery machines.

According to the illustrated embodiment, the alignment section 40 is configured to be magnetically attached to the base section 20. In this regard, the alignment section 40 can include a magnet or a plurality of magnets and the base section 20 can be entirely made of a ferromagnetic material such as steel or the base section 20 include portions that are ferromagnetic. Alternatively, alignment section 40 can be made entirely of, or only portions are made of, a ferromagnetic material such as steel and the base section 20 can include a magnet or a plurality of magnets.

Figure 3:
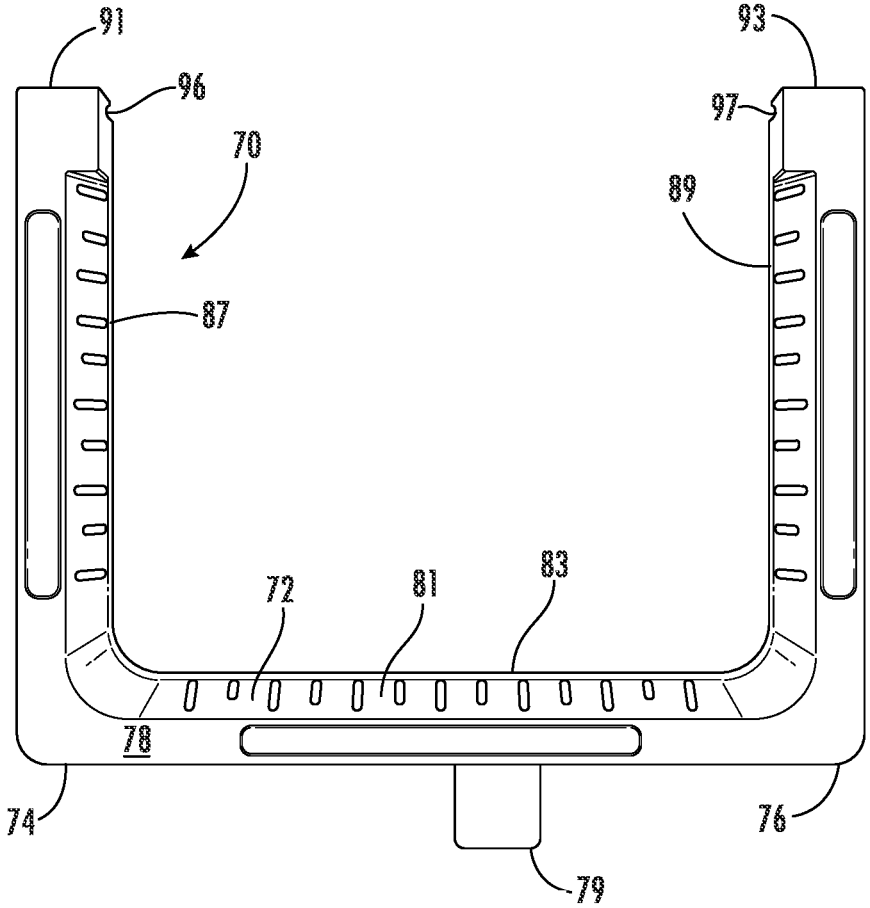
FIG. 3 is a plan view of the retention section shown in FIG. 1.
Figure 4:
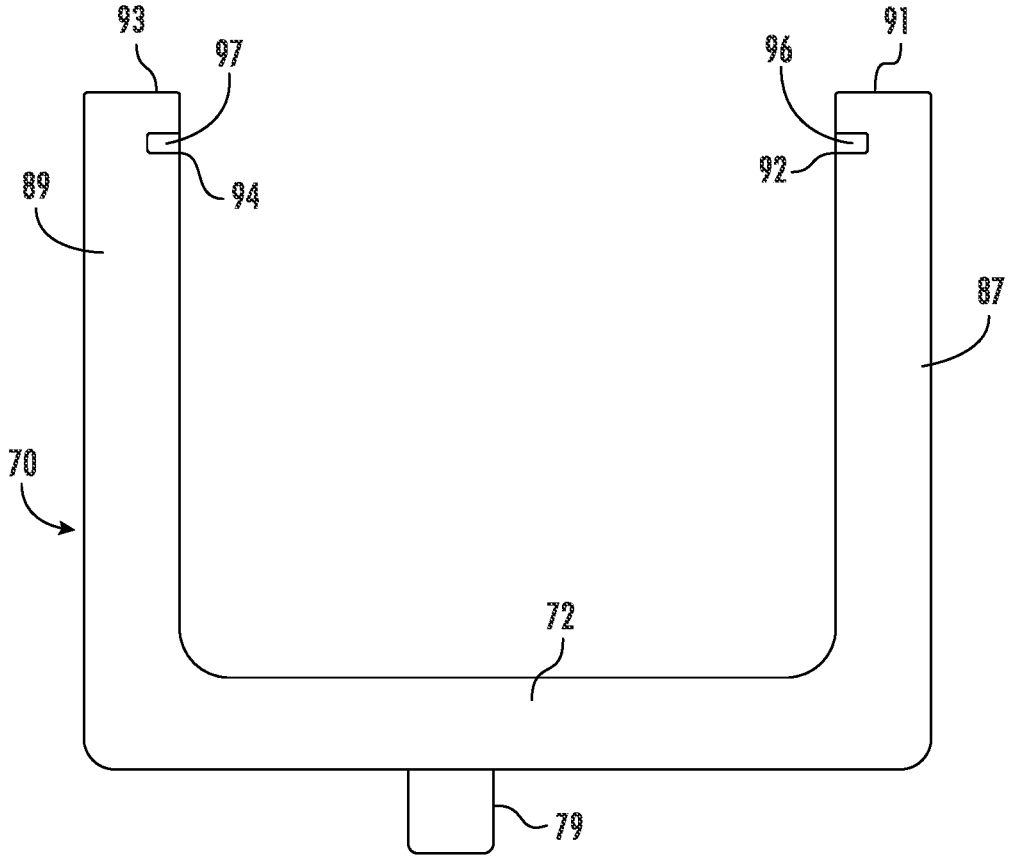
FIG. 4 is a plan view of the underside of the retention section of the embroidery frame shown in FIG. 3.
Figure 5:
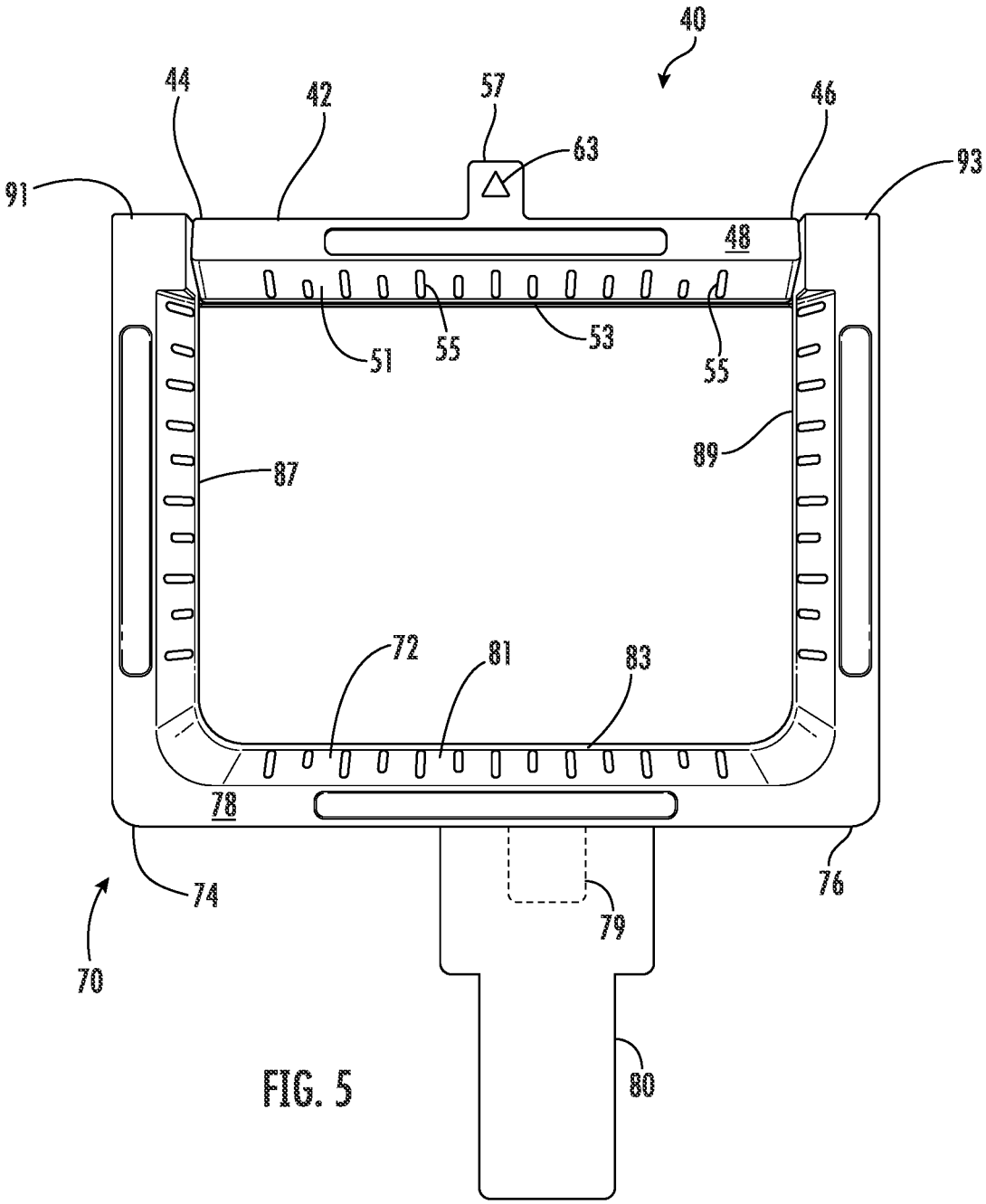
FIG. 5 is a top plan view of an assembled embroidery frame according to the present invention with a removable handle attached.

Referring now to FIG. 1 and FIG. 3, the retention section is substantially U-shaped 70 includes a body 72 that has a first arm 87 and a second arm 89 extending from the same side generally parallel to each other. The body 72 extends from a first end 74 to a second end 76. The body 72 defines a top surface 78 and an index side 81 that slopes from the top surface 78 to an edge 83. A plurality of index marks 85 are defined on the index side 81.

The first arm 87 extends away from the body 72 on the index side 81 at the first end 74 of the body 72. The second arm 89 extends away from the body 72 on the index side 81 at the second end 76 of the body 72. As shown in FIG. 3, the first arm 87 and the second arm 89 are generally linear and parallel to each other such that they are spaced apart. It should be appreciated that in other embodiments, the first arm 87 and the second arm 89 can be various geometric configurations such as curved, angular, and the like. The first arm 87 and the second arm 89 of the retention section 70 define continuations of the surface 78, the index side 81 and the edge 83.

In all of the embodiments, the first arm 87 and the second arm 89 extend to ends that can be received by the first end 44 and the second end 46 of the attachment section 40 respectively. According to the illustrated embodiment, the first arm 87 extends to an end that defines a first gudgeon 91 that is configured to engage the first pintle 59. Likewise, the second arm 89 extends to an end that defines a second gudgeon 93 that is configured to engage the second pintle 61.

The first gudgeon 91 and the second gudgeon 93 define slots 92 and 94 respectively. The slot 92 extends to an open end 96 and the slot 94 extends when open end 97. The slots 92 and 94 are configured to receive the first pintle 59 and the second pintle 61 when the alignment section 40 is positioned on the base section 20. In this regard, the alignment section 40 can be positioned in a predetermined location relative to the base 20 before the retention section 70 is engaged with the alignment section 40.

A tab 79 extends from the body 72 of the retention section 70 opposite the direction of the first arm 87 and the second arm 89. The tab 79 can be used to grasp retention section 70 during positioning and movement of the retention section 70 as will be discussed further below with regards to the operation of the broader frame 10.

When the alignment section 40 is positioned on the base section 20 and the retention section 70 is engaged with the alignment section 40, the retention section 40 is movable about an axis defined by the first pintle 59 and the second pintle 61. In this regard, the retention section 70 is movable between a first position in which the body 72 of the retention section 70 is spaced away from the base 20 to a second position in which the body 72 of the retention section 70 is on the base 20. The tab 79 is configured such that control of the retention section 70 can be maintained as it moves from the first position toward the second position. It should be appreciated that when the retention section 70 is near the second position, magnetic forces are greater than in other positions and control of the retention section 70 is facilitated by grasp of the tab 79.

A detachable handle 80 is provided to fit over the tab 79 such that it is received thereon. The length of the detachable handle 80 provides additional leverage for assistance in moving the retention section 70 between the first position and the second position.

The present invention can be better understood by a description of the operation thereof. Compared to conventional embroidery frames, it is believed that the operation of the embroidery frame according to the present invention can require less effort and be safer. In this regard, detachment and attachment forces can be more easily managed because of at least three factors: 1) The alignment component is much smaller than the combination of the alignment component and retention component and thus experiences less total force, during alignment with and attachment to a base component when compared to conventional top hoops. 2) The retention component can be lowered under control onto the base section while in alignment with the alignment component because the retention component is configured to hinge around the alignment pintles pins. 3) The retention component is configured to receive a removable arm or lever such that an operator can control the motion of the retention component relative to the alignment section and the base section via the removable arm, thus obtaining a mechanical advantage while keeping their hand clear of pinch points in the embroidery frame.

In this regard, a method for using the embroidery can frame 10 includes the steps as follows: choosing one of a base section 20, 120, or other base section that is configured to engage the machine to be used prior to the first step of positioning fabric 14 over the base section; positioning stabilizer (backing fabric) over the base section 20; positioning fabric 14 over the stabilizer and the base section 20; positioning the alignment section 40 such that the stabilizer and the fabric 14 is sandwiched between the alignment section 40 and a portion of the base section 20 and the alignment section 40 is positioned in a predetermined position relative to the base section 20; positioning the retention section 70 such that the retention section 70 is movably engaged with the alignment section 40 and in a first position not directly engaged with the base section 20; attaching a handle 80 to the retention section 70 via the tab 79 of the retention section 70; using the handle 80 to guide the retention section 70 from the first, open position to the second, closed position thereby closing the retention section 70 while it is engaged with the alignment section 40 by moving the retention section 70 from the first position, open position, to a second, closed, position in which the retention section 70 is positioned such that the stabilizer and the fabric 14 is sandwiched between the retention section 70 and the base section; removing the handle 80; embroidering fabric 14 in a predetermined manner; engaging the handle 80 with tab 79; opening the retention section 70 while it is engaged with the alignment section by moving the retention section 70 from the second, closed position, to the first, open position; removing the retention section 70 from the alignment section; removing the alignment section from the base; and removing the fabric 14 from the base.

According to an alternative embodiment, there is provided an alignment section 40 that is not configured to be magnetically attached to the base 20. In this embodiment, the retention section 70 is configured to be magnetically attached to the base 20 and alignment section 40 is captured and retained against the base 20 by the engagement of the first gudgeon 91 with the first pintle 59 and the engagement of the second gudgeon 93 with the second pintle 61. During the alignment and attachment step described above, alignment section 40 of this embodiment is held in place manually or clip or some other temporary device as the retention section 70 is engaged with the alignment section 40 and move between the first position and a second position.

Figure 11:
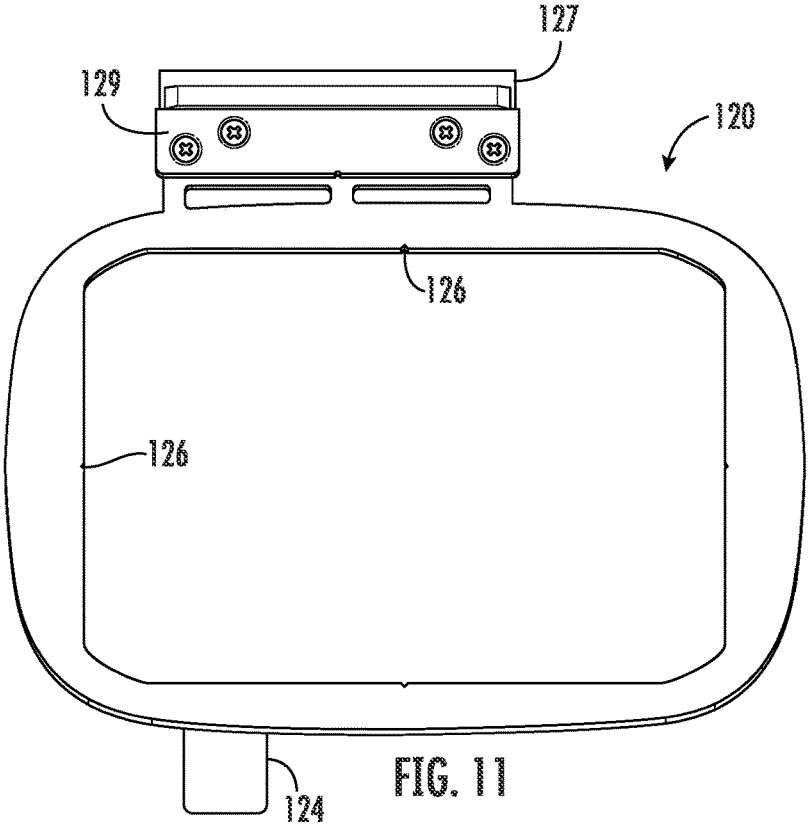
FIG. 11 is a plan view of a base section of the embroidery frame according to another embodiment of the present invention.
Figure 12:
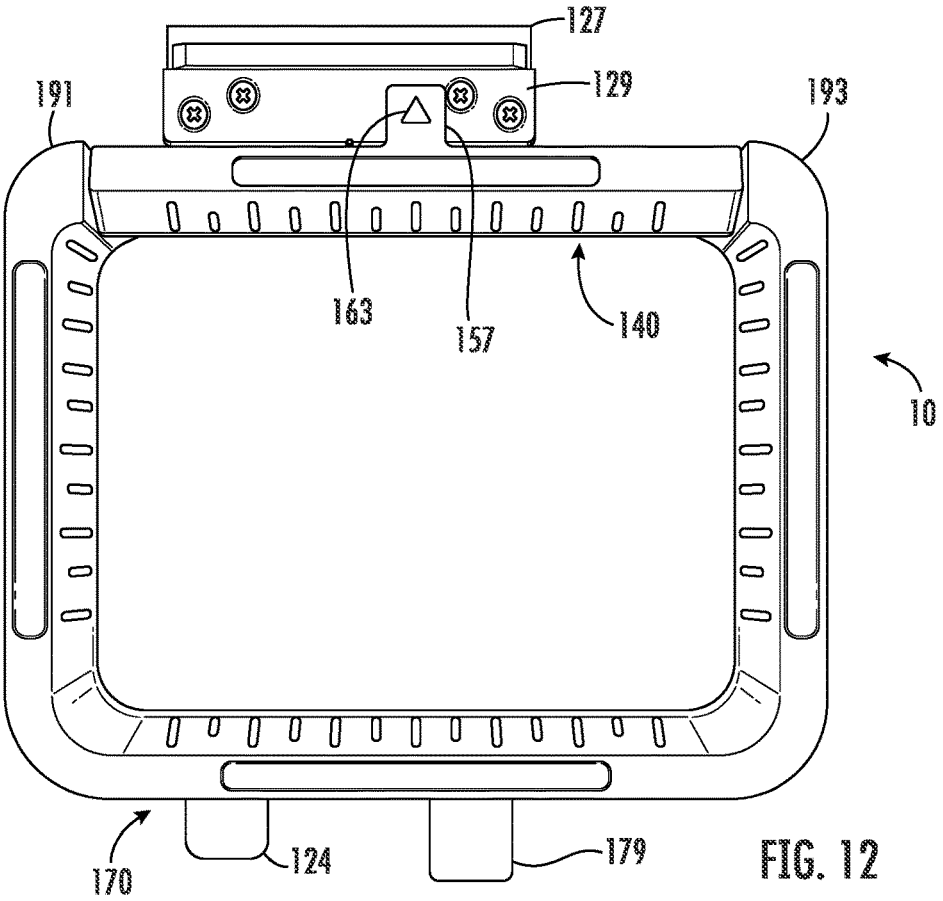
FIG. 12 is a plan view of the embroidery frame according to the embodiment of the present invention of FIG. 8.

According to an alternative embodiment of the present invention, shown in FIGS. 11 and 12, there is provided an embroidery frame 110 that is configured to engage with a particular embroidery machine, not shown. The embroidery frame 110 includes elements that are substantially similar to the embroidery frame 10 described above and elements associated with reference numbers in the 100 series can be generally understood from the description above of elements associated with similar numbers in the zero series.

The embroidery frame 110 includes a base section 120, attachment section 140, and a retention section 170. The base section 120 is provided with a reference mark 126. The base section 120 includes a connector 127 that is configured to connect the base section 127, and therefore the embroidery frame 110, to an embroidery machine. The connector 127 includes features 129 that provide a keyed fit an attachment for a particular embroidery machine. A tab 124 is positioned on the base section 120 to be used during assembly and disassembly of the embroidery frame 110.

Referring now to FIG. 12, alignment section 140 includes a tab 157 that includes an alignment mark 163 defined thereon. Retention section 170 extends to gudgeons 191 and 193 and includes a tab 179.

Figure 13:
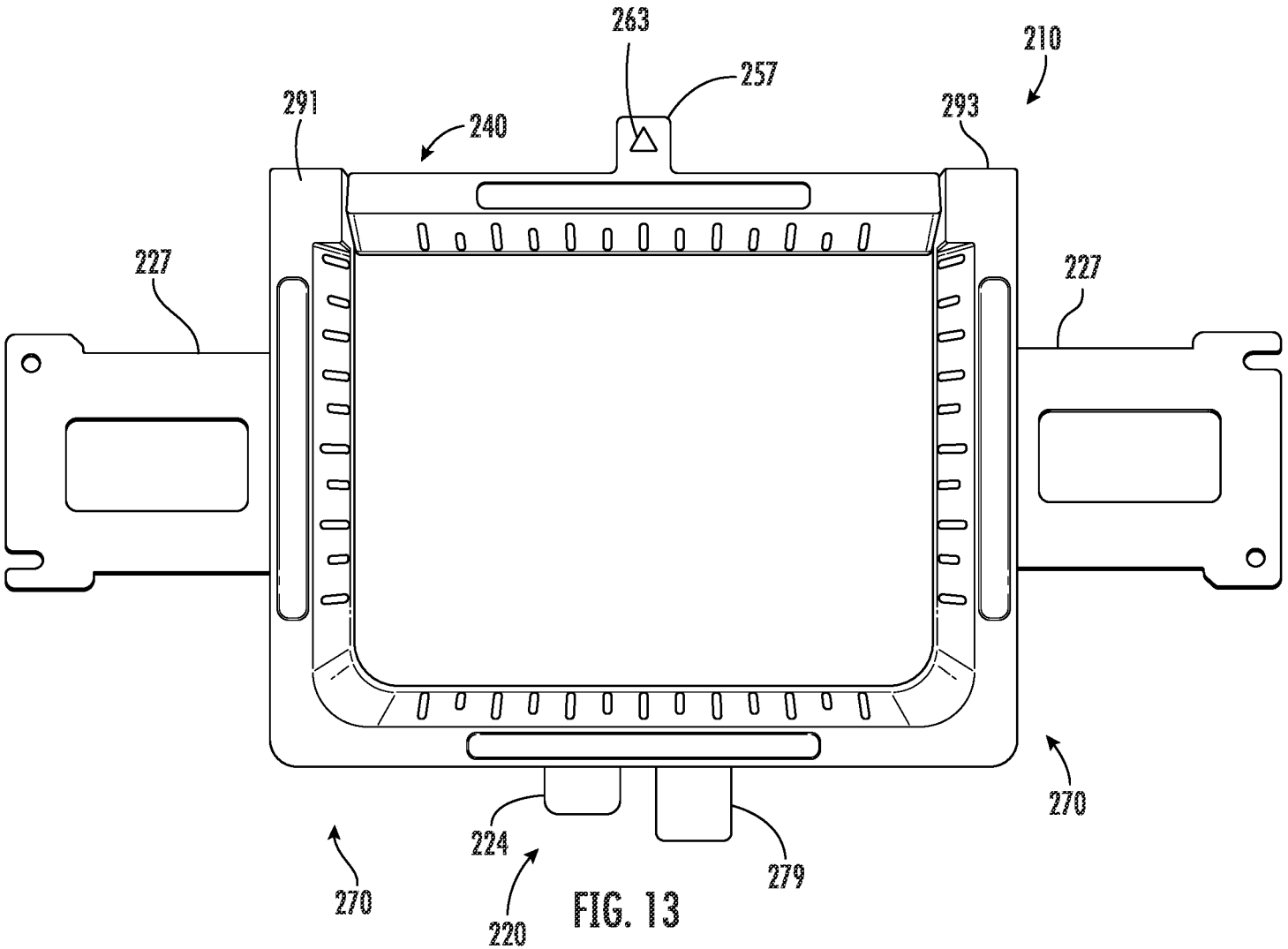
FIG. 13 is a plan view of the embroidery frame according to another embodiment of the present invention.

According to another alternative embodiment of the present invention, shown in FIG. 13, there is provided an embroidery frame 210 that is configured to engage with a particular embroidery machine, not shown. The embroidery frame 210 includes elements that are substantially similar to the embroidery frame 10 described above and elements associated with reference numbers in the 200 series can be generally understood from the description above of elements associated with similar numbers in the zero series.

The embroidery frame 210 this includes a base section 220, attachment section 240, and a retention section 270. The base section 220 is provided with a reference mark 226. The base section 220 includes a connector to 27 that is configured to connect the base section 227, and therefore the embroidery frame 210, to an embroidery machine. The connector 227 includes features 229 that provide a keyed fit an attachment for a particular embroidery machine. A tab 224 is positioned on the base section 220 to be used during assembly and disassembly of the embroidery frame 210. The alignment section 240 includes a tab 257 that includes an alignment mark 263 defined thereon. Retention section 270 extends to gudgeons 291 and 293 and includes a tab 279.

Figure 14:
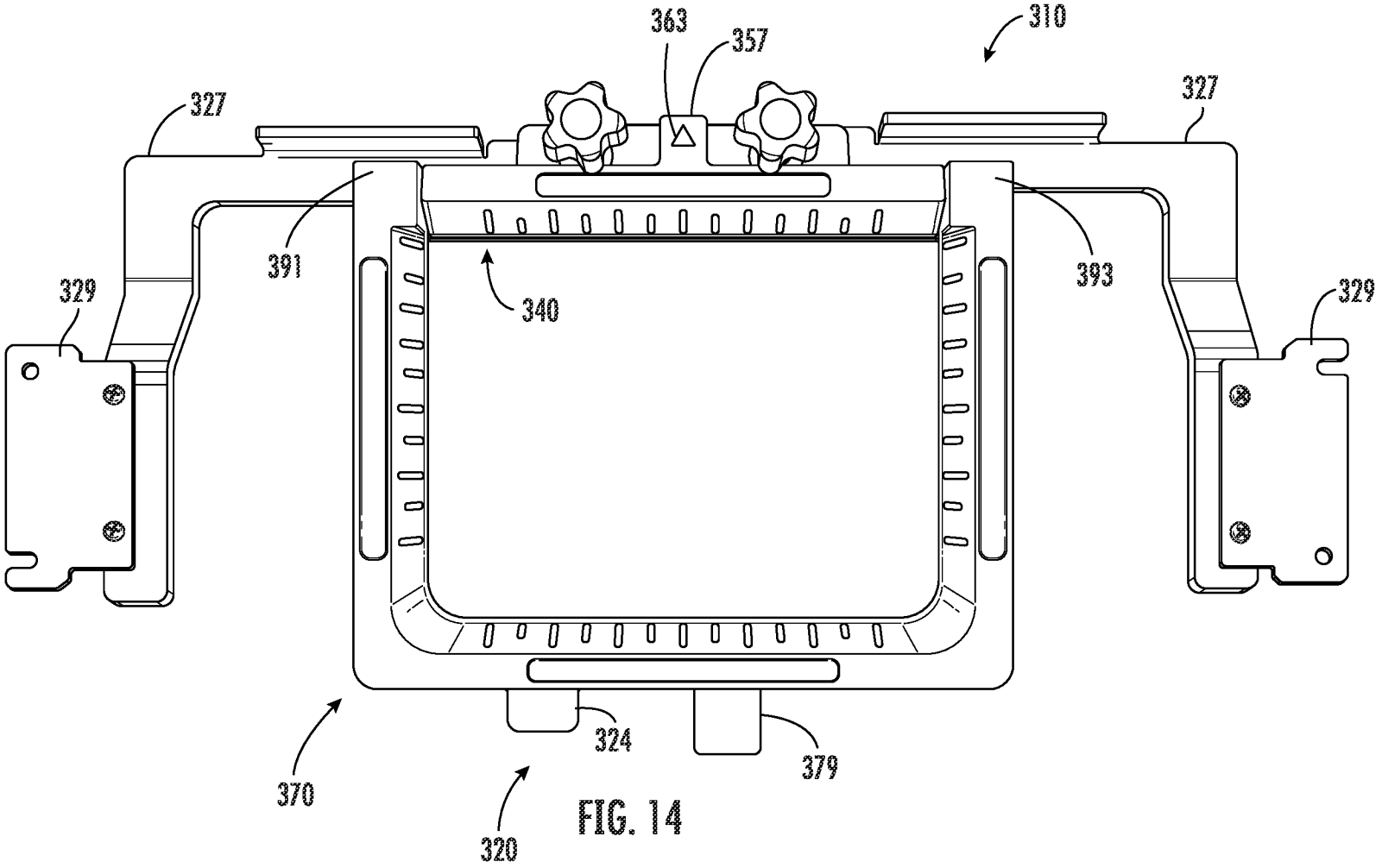
FIG. 14 is a plan view of the embroidery frame according to another embodiment of the present invention.

According to yet another alternative embodiment of the present invention, shown in FIG. 14, there is provided an embroidery frame 310 that is configured to engage with a particular embroidery machine, not shown. The embroidery frame 310 includes elements that are substantially similar to the embroidery frame 10 described above and elements associated with reference numbers in the 300 series can be generally understood from the description above of elements associated with similar numbers in the zero series.

The embroidery frame 310 includes a base section 320, attachment section 40, and a retention section 370. The base section 320 is provided with a reference mark 326. The base section 320 includes a connector 327 that is configured to connect the base section 220, and therefore the embroidery frame 310, to a particular embroidery machine. The connector 327 includes features 329 that provide a keyed fit an attachment for a particular embroidery machine. A tab 324 is positioned on the base section 320. To be used during assembly and disassembly of the embroidery frame 310. The alignment section 340 includes a tab 357 that includes an alignment mark 363 defined thereon. Retention section 370 extends to gudgeons 391 and 393 and includes a tab 379.

The foregoing has described an embroidery frame. All of the features disclosed in this specification, and/or all of the steps of any method or process so disclosed, may be combined in any combination, except combinations where at least some of such features and/or steps are mutually exclusive.

Each feature disclosed in this specification may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends, or to any novel one, or any novel combination, of the steps of any method or process so disclosed.

What is claimed is:

1. An embroidery frame having at least three sections, the frame comprising:

a base section that defines a perimeter and the perimeter includes a first portion of the perimeter and a second portion of the perimeter;

an alignment section that is configured to be positioned on the base section such that it covers the first portion of the perimeter of the base section while leaving the second portion of the perimeter of the base section uncovered and the alignment section includes a first end and a second end that together define an axis;

a retention section that is configured to cover the second portion of the perimeter of the base section while not covering the first portion of the perimeter of the base section and to be engaged with the alignment section at the first end and the second end such that the retention section is movable relative to the alignment section about the axis and such that alignment of the retention section with the base section is determined by alignment of the alignment section with the base section; and wherein at least one of the alignment section and the retention section is configured to be magnetically attached to the base section.

2. The embroidery frame according to claim 1, wherein the retention section is configured to be magnetically attached to the base section.

3. The embroidery frame according to claim 2, wherein the alignment section is configured to be magnetically attached to the base section.

4. The embroidery frame according to claim 1, wherein at least one of the first and the second ends is configured to engage a portion of the retention section.

5. The embroidery frame according to claim 4, wherein both of the first end and the second end of the alignment section are configured to engage respective portions of the retention section.

6. The embroidery frame according to claim 5, wherein the retention section is substantially U-shaped and has a body section with two arms extending from opposite ends of the body section to define a first end and a second end wherein the first end of the retention section is configured to be engaged with the first end of the alignment section and the second end of the retention section is configured to be engaged with the second end of the alignment section.

7. The embroidery frame according to claim 6, wherein when the alignment section is positioned on the base section and the retention section is engaged with the alignment section, the retention section can move from a first position in which the body of the retention section is spaced away from the base to a second position in which the body of the retention section is on the base.

8. The embroidery frame according to claim 7, wherein the retention section is magnetically attached to the base.

9. The embroidery frame according to claim 8, wherein a first pintle extends from the first end of the alignment section and a second pintle extends from the second end of the alignment section such that each of the first pintle and the second pintle are configured to receive the respective portions of the retention section.

10. The embroidery frame according to claim 8, wherein the alignment section is retained against the base by the retention section.

11. The embroidery frame according to claim 8, wherein a tab extends from the retention section.

12. The embroidery frame according to claim 11, including a detachable handle that is configured to be received by the tab of the extension section.

13. An embroidery frame having two hoops, the frame comprising:

a base hoop that includes a first portion of the base hoop and a second portion of the base hoop;

a top hoop comprised of an alignment section that is configured to cover the first portion of the base hoop while not covering the second portion of the base hoop wherein the alignment section includes a first end and a second end that together define an axis and a retention section that is configured to cover the second portion of the base hoop while not covering the first portion of the base hoop and that is configured to be engaged with the alignment section at the first end and the second end such that the retention section is movable relative to the alignment section about the axis; and wherein at least one of the alignment section and the retention section is configured to be magnetically attached to the base hoop.

14. The embroidery frame according to claim 13, wherein the retention section is configured to be magnetically attached to the base hoop.

15. The embroidery frame according to claim 14, wherein the alignment section is configured to be magnetically attached to the base hoop.

16. The embroidery frame according to claim 13, wherein at least one of the first and the second ends is configured to engage a portion of the retention section.

17. The embroidery frame according to claim 16, wherein both of the first end and the second end of the alignment section are configured to engage respective portions of the retention section.

18. The embroidery frame according to claim 17, wherein the retention section is substantially U-shaped and has a body section with two arms extending from opposite ends of the body section to define a first end and a second end wherein the first end of the retention section is configured to be engaged with the first end of the alignment section and the second end of the retention section is configured to be engaged with the second end of the alignment section.

19. The embroidery frame according to claim 18, wherein when the alignment section is positioned on the base hoop and the retention section is engaged with the alignment section, the retention section can move from a first position in which the body of the retention section is spaced away from the base to a second position in which the body of the retention section is on the base.

* * * * *